United States Patent [19]

Breuninger

[11] Patent Number: 4,520,753

[45] Date of Patent: Jun. 4, 1985

[54] EGG LATHE

[75] Inventor: Robert E. Breuninger, Lancaster, Pa.

[73] Assignees: John F. Hinkle, Jr., Columbia; Wendell B. Stockdale, Lancaster, both of Pa. ; a part interest

[21] Appl. No.: 605,373

[22] Filed: Apr. 27, 1984

Related U.S. Application Data

[63] Continuation-in-part of Ser. No. 415,652, Sep. 7, 1982, abandoned.

[51] Int. Cl.[3] ..... B05C 13/02

[52] U.S. Cl. ..... 118/500; 118/13; 82/2 R

[58] Field of Search ..... 118/232, 13, 320, 500, 118/503; 82/2 R

[56] References Cited

U.S. PATENT DOCUMENTS

| | | | |
|---|---|---|---|
| 2,515,359 | 7/1950 | Steiner | 118/500 |
| 2,727,325 | 12/1955 | Jurinic | 118/500 X |
| 3,358,644 | 12/1967 | Greene | 118/503 X |
| 3,848,564 | 11/1974 | Kull | 118/13 |
| 4,007,704 | 2/1977 | Haviland | 118/319 X |

*Primary Examiner*—John D. Smith
*Assistant Examiner*—Bernard F. Plantz
*Attorney, Agent, or Firm*—Louis E. Hay

[57] ABSTRACT

A motor driven egg lathe, which may be in a self-storing container, and which maintains the functional relationship of the internal elements by embedding them in a cellular polymeric block.

15 Claims, 7 Drawing Figures

EGG LATHE

REFERENCE TO RELATED APPLICATION

This is a continuation-in-part application of parent application Ser. No. 415,652 Egg Lathe filed Sept. 7, 1982, now abandoned.

REFERENCE TO RELATED U.S. PATENTS

U.S. Pat. No. 2,515,359 Easel—Steiner.

U.S. Pat. No. 253,055 Egg Decorating Device—Fudro.

BACKGROUND OF THE INVENTION

Prior known devices which were intended to be used in the coloring of eggs have all been relatively large and have been awkward to store because of their general shape. Another disadvantage of prior devices is that it requires one hand to operate the device, with the result that only one hand is free for the other tasks associated with the coloring of the eggs.

SUMMARY OF THE INVENTION

The present egg lathe is in a relatively small container which is self-storing, as for example, on a closet shelf. There are no protruding parts to snag other objects on a shelf. The egg lathe is especially economical to manufacture because the operating components within the container are embedded in a cellular packing material and require no other mounting means such as boards, brackets and screws. There are no metal parts which are not readily available. The egg lathe is preferably driven by a small battery powered motor, thus leaving both of the operator's hands free for the tasks associated with the coloring of the eggs.

DESCRIPTION OF THE PREFERRED EMBODIMENT

The working elements of the egg lathe 10, constituting the first species of the present invention, are all within a conveniently sized and shaped container 12, which may or may not be provided with a removable storage cover 14 (shown in phantom lines) which may be used when it is desired to store the egg lathe for future use.

The container 12 may be made of any suitable material such as heavy cardboard, plastic or flake board, and will preferably be made to have a fixed bottom **12*a* and a detachable cover 12*b***.

Figure 1:
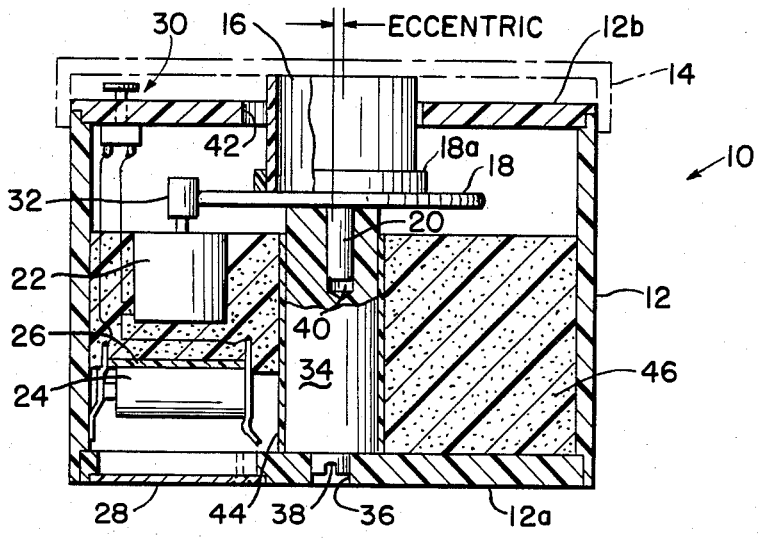
FIG. 1 is a vertical cross-section through the center of one species of the egg lathe and depicting the internal elements embedded in a cellular material.
Figure 2:
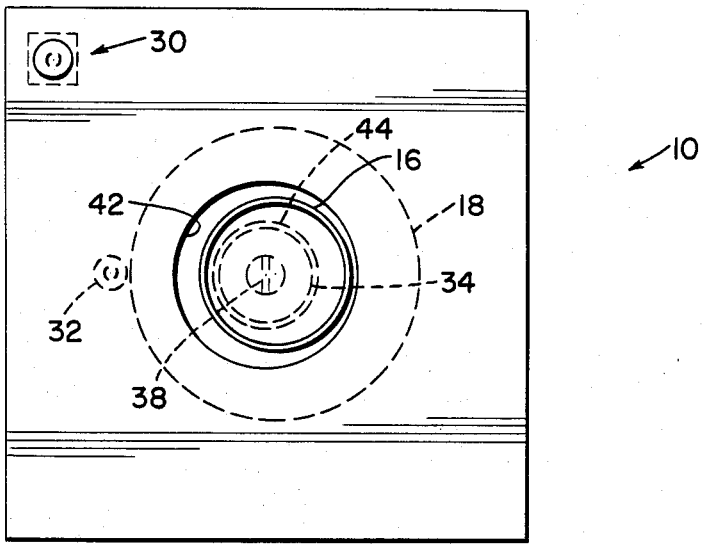
FIG. 2 is a plan view of the egg lathe with the storage cover removed.

As depicted in FIG. 1, the egg lathe has an egg cup 16, the major portion of which is within the container where it is attached to the upper face of a driven disc 18. The egg cup 16 is preferably made of a material such as cardboard, which is not prone to cracking the shell of an egg. The egg cup may be attached to the driven disc by means of an adhesive, or by other means which will be described below.

The driven disc 18, which may be made of wood or a plastic material, has a depending stem 20. The egg cup 16, the driven disc 18, and the stem 20 have a common axis of rotation.

Figure 3:
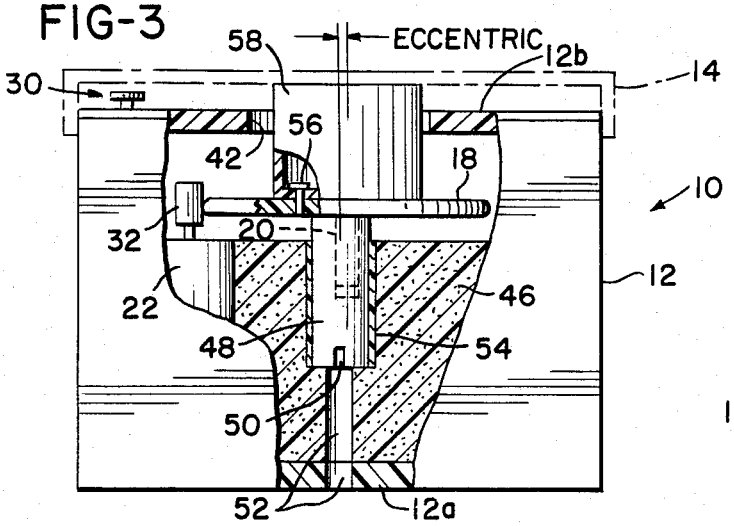
FIG. 3 is an elevation of the egg lathe, partially in section to show the internal elements of a variation of the elements depicted in FIG. 1.

The driven disc 18 may have a flat upper face as depicted in FIG. 3, or, it may be made with a hub **18*a* as depicted in FIG. 1. As depicted in FIG. 1, the hub has a recess for receiving the egg cup 16**.

There are several ways in which the egg cup may be formed and joined to the driven disc. As depicted in FIG. 1, the egg cup may be cut from circular tubing, and may be detachably joined to the driven disc by sliding the cup into a recess; preferably with a snug fit. The cup may also be permanently joined with an adhesive.

Figure 4:
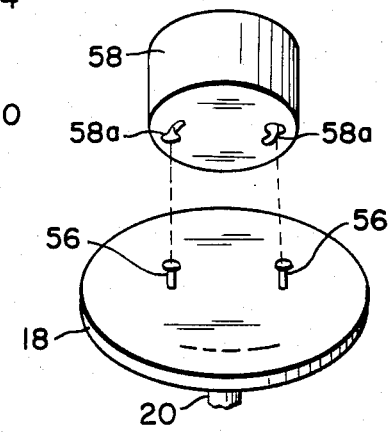
FIG. 4 is a fragmentary perspective depicting a detachable egg cup.

If desired, the cup may also be made to have a closed end at the bottom of the cup, as depicted in FIG. 4 (without slots **58*a*). A cup made in this manner may be detachably joined by sliding it into the recess in hub 18*a*, or, it may be permanently joined with an adhesive. If a cup with a closed bottom is to be permanently joined to the driven disc, the hub 18*a*** may be omitted from the driven disc.

The egg cup is rotated by a motor 22 which is energized by an electrical source of energy such as a battery 24 which is detachably retained in a conventional battery holder 26 having lead terminals for connecting to wires. The container 12 is provided with an access cover 28 which is adjacent to the battery. The location of the battery is optional within the scope of the invention. For example, the battery may be mounted to be accessible when the detachable cover **12*b*** is lifted.

Although a more expensive motor at higher voltage, such as 110 volts, may be used, an ordinary battery powered motor, such as used in toys, will be found to be satisfactory. Motors, battery holders, and switches, such as switch 30, may be found at many stores such as Radio Shack. The switch may be mounted at any convenient location, such as the top side of the container, as depicted.

Motors, such as motor 22 described above, all have a small diameter drive shaft which is too small in diameter and not ideal for the direct friction driving of the egg cup through the driven disc 18. A pliable sleeve 32 is therefore cemented to the drive shaft as depicted. The sleeve 32 may be made of any suitable material such as rubber or neoprene. The sleeve increases the diameter of the driving shaft and also increases the driving friction in order to prevent slippage between the motor and the driven disc. The manner of controlling the amount of friction will be described below.

The driven disc is supported on an eccentrically adjustable vertical support post 34. The post may be made of a hardwood dowel rod, or of a plastic rod of suitable composition. The lower end of the support post is turned to a reduced diameter portion which is rotatably supported in an aperture 36 in the bottom of the container. The reduced diameter portion of the support post is provided with a screw driver slot 38. The reduced diameter portion is on the longitudinal axis of the support post; however, the stem 20 is rotatable in an aperture 40 which is displaced from the longitudinal axis of the support post in order to provide an eccentric adjustment for controlling the pressure between the driven disc 18 and the sleeve 32 on the motor.

The aperture 42 in the detachable cover **12*b* is of such diameter, and is positioned to permit the eccentric adjustment of the driven disc 18** as described above.

The support post 34 may, or may not, be within a sleeve 44. As depicted in FIG. 1, the motor 22, and the support post (with or without sleeve 44) are embedded in cellular polymeric material 46, such as Styrofoam. The cellular polymeric material may be formed from a block which is then inserted into the container 12, or, the raw material may be molded to the required shape. Numerous manufacturers make suitable raw materials and their characteristics and methods of forming them into final shapes is well known in the art, for which reasons they require no further description.

A variation of the design depicted in FIG. 1 is shown in FIGS. 3 and 4. The support post 48 is supported at the lower end by the cellular polymeric material 46. The lower end of the support post has a screwdriver slot 50. Apertures 52 extend through the bottom **12*a* of the container and the polymeric material to communicate with the screwdriver slot 50. Sleeve 54 is comparable but shorter than sleeve 44 as depicted in FIG. 1**.

The drive disc 18 contains two headed pins 56 of conventional configuration which engage slots **58*a* in detachable egg cup 58. One end of each arcuate slot 58*a* is large enough to permit passage of the head on pins 56, after which the cup is rotated to place the smaller portion of the slots under the head on the pins. The detachable egg cup 58 may be used in the design depicted in FIG. 1 and in the second species of the egg lathe depicted in FIGS. 5–7**. Detachable egg cups may be made in several sizes which are self-storing by nesting in each other.

Figure 5:
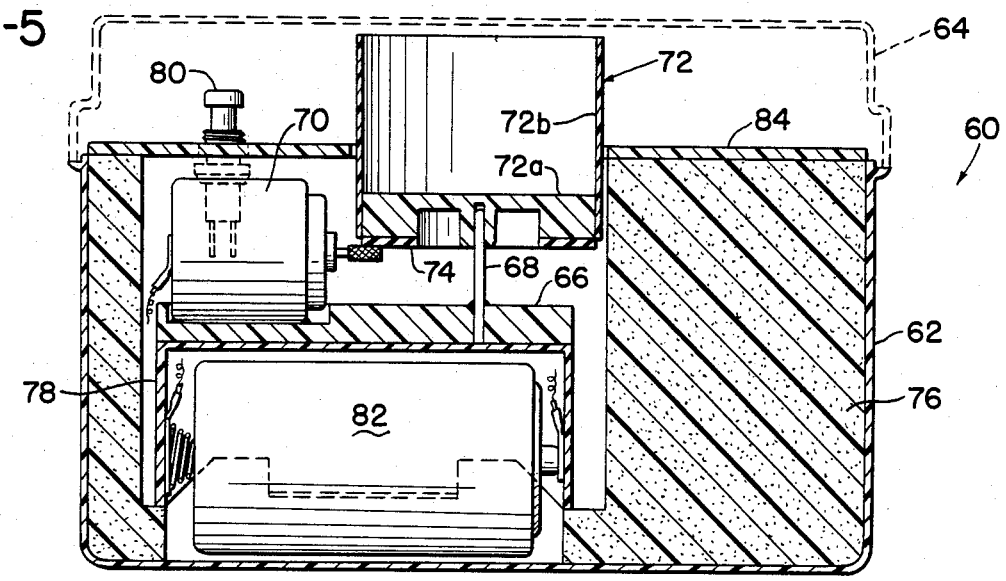
FIG. 5 which is comparable to FIG. 1, is a vertical cross-section through the center of a second species of the egg lathe and depicts the internal elements embedded or supported by a cellular material.
Figure 6:
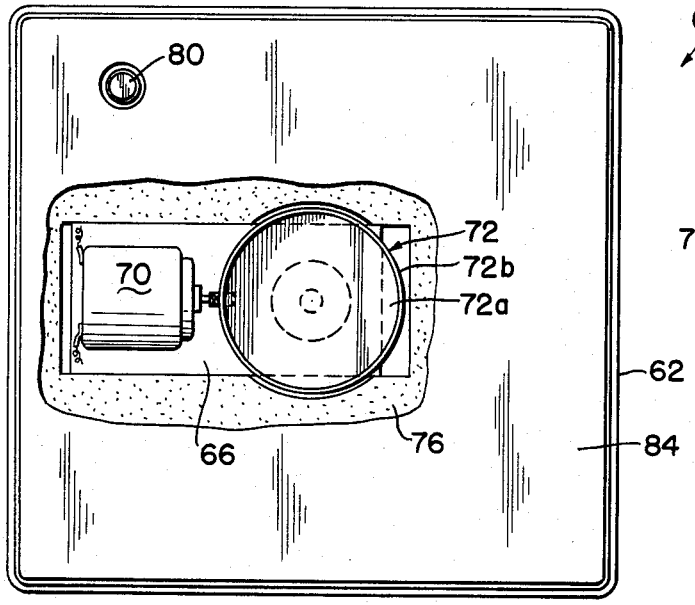
FIG. 6 is a plan view of the egg lathe depicted in FIG. 5, and with a portion of the top cover broken to better show internal elements; and, FIG. 7 is a fragmentary vertical section depicting an alternate drive.
Figure 7:
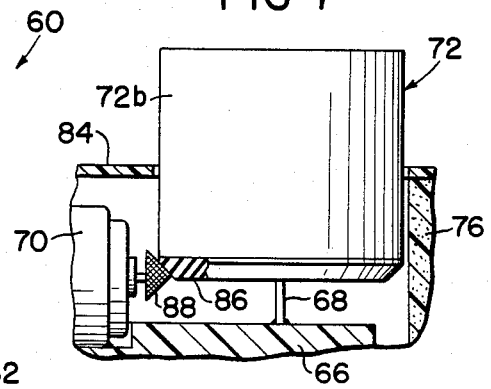

Specific reference is now made to FIGS. 5–7 which depict a second species of the present invention. The principal differences over the first species are: (1) the manner in which the operating elements are supported by the cellular polymeric material; (2) the motor is mounted horizontally; and (3) the friction drive is maintained by weight of the egg cup and an egg in the cup, rather than by mechanical adjustment.

The working elements of the egg lathe 60 are all within a conveniently sized and shaped container 62 which may or may not be provided with a removable storage cover 64 (shown in phantom lines) which may be used when it is desired to store the egg lathe for future use. The applicant found it convenient to use a standard plastic box with a hinged cover, as for example, Sterling No. 270 which has an opening of about five inches square and a depth of two and three-quarters of an inch.

The working elements are conveniently formed into a sub-assembly comprising a base element 66 which may be of a plastic material, a vertical pin 68 upwardly extending from and affixed to the base element 66, a horizontally mounted motor 70 which is comparable to the motor 22 which was previously described, an egg cup 72 which rotates on the vertical pin 68 and with the bottom thereof resting on the extending shaft of motor 70. The motor may be mounted on the base element 66 by adhesives, or by other suitable means.

The egg cup 72 may be made in any desired manner, or, it may be made as depicted in FIG. 5 with a base disc **72*a* and a sleeve portion 72*b* extending upward from the base disc 72*a***.

The bottom of the egg cup 72 is provided with an affixed friction disc 74 which may be made of ordinary flat rubber stock or of a comparable compressible material. As depicted, the extending shaft of the motor is knurled to further increase the driving friction between the motor and the egg cup. The sub-assembly described above is embedded in a block of cellular polymeric material which may be formed by any convenient manner. The polymeric material also supports a conventional battery holder 78, and a switch 80. The battery holder detachably retains a battery 82. The battery, switch, and motor are connected with a conventional wiring circuit which is comparable with the circuit depicted in FIG. 1.

Affixed to the upper side of the polymeric block 76 is a cover 84 which may be made of any suitable material and is provided with apertures through which the egg cup and the switch extend. In order to present a pleasing appearance, the cover may be made of the same material and color as the container 62.

If the block of polymeric material 76 is of such size as will permit easy entry into the container 62, the container does not require a battery access cover, such as cover 28 in FIG. 1. The battery may be changed by sliding the entire assembly from the container.

FIG. 7 depicts an alternate friction drive between the motor and the egg cup. The friction disc 86 is comparable to the friction disc 74 with the exception of the bevel edge at the perimeter which is engaged by a conical tip 88 which is affixed to the stem of the motor.

Although both species of the egg lathe are depicted and described as being in integral containers, such containers are not necessary to having a functional egg lathe. Within the scope of the present invention, the elements which are embedded in the cellular polymeric material are held and supported in their functional relationship with the polymeric material forming a necessary element of the combination. The cellular polymeric material is not used as mere packing material to be discarded. The container is a useful and desirable component of the present egg lathe; however, a functional combination exists without use of the container. When building an egg lathe which is not in a container, it is preferable to have the battery access at the bottom, and to affix a flat cover on the top side of the polymeric block in order to cover the cavities in the block.

The egg lathe constituting the present invention permits the operator to use both hands for manipulating brushes, bottles of coloring liquids, and the egg being colored. For example, the fingers on one hand may be used to steady an egg in the upright position which will permit application of various color bands which are of uniform width, and are also more nearly perpendicular with the longitudinal axis of the egg, to thereby produce a more pleasingly colored egg. By being able to revolve an egg more nearly about its longitudinal axis, it is also much easier to color an egg with various color designs.

It is to be understood that the embodiments of the present invention as shown and described are to be regarded merely as illustrative, and that the invention is susceptible to variations, modifications and changes, without regard to specific construction methods, within the scope of the appended claims.

I claim:

1. An egg lathe for use in coloring eggs, said egg lathe comprising:

(a) a circular egg cup open at the upper end and rotatable about the vertical longitudinal axis of rotation;

(b) a horizontal driven disc coaxially joined to the bottom of said egg cup, said driven disc having a diameter at least as large as the diameter of said egg cup and further having a coaxial depending stem;

(c) a vertically mounted electric motor having a drive shaft engaging the perimeter of said driven disc for rotating said driven disc and said egg cup;

(d) an elongated vertical support means having a downward extending aperture for rotatably receiving the depending stem on said driven disc, said support means being adjustable for controlling the driving friction between said motor and said driven disc; and, (e) a cellular polymeric block adapted for embedding and supporting in functional relationship therein, said electric motor and said vertical support means.

2. An egg lathe in accordance with claim 1 in which said egg cup is detachably joined to said driven disc.

3. An egg lathe in accordance with claim 1, and further having a container adapted for housing said block and embedded contents.

4. An egg lathe in accordance with claim 2, and further having a container adapted for housing said block and embedded contents.

5. An egg lathe for use in coloring eggs, said egg lathe comprising:

(a) a circular egg cup open at the upper end and rotatable about the vertical longitudinal axis of rotation;

(b) a horizontal driven disc coaxially joined to the bottom of said egg cup, said driven disc having a diameter at least as large as the diameter of said egg cup and further having a coaxial depending stem;

(c) a vertically mounted electric motor having a drive shaft engaging the perimeter of said driven disc for rotating said driven disc and said egg cup;

(d) an elongated vertical support means having a downward extending aperture for rotatably receiving the depending stem on said driven disc and supporting said driven disc with the axis of said aperture being parallel with and displaced from the longitudinal axis of said vertical support means, said vertical support means being rotatably adjustable for controlling the driving friction between said motor and said driven disc; and (e) a cellular polymeric block adapted for embedding and supporting in functional relationship therein, said electric motor and said vertical support means.

6. An egg lathe in accordance with claim 5 in which said egg cup is detachably joined to said driven disc.

7. An egg lathe in accordance with claim 5, and further having a container adapted for housing said block and embedded contents.

8. An egg lathe in accordance with claim 6, and further having an container adapted for housing said block and embedded contents.

9. An egg lathe for use in coloring eggs, said egg lathe comprising:

(a) a hollow container having a substantially horizontal bottom side and a substantially horizontal upper side, said upper side having a circular aperture therethrough;

(b) a circular egg cup having an open upper end extending upwardly through the aperture in the upper side of said container and a lower end extending downward into said container, said egg cup being rotatable about the vertical longitudinal axis of rotation;

(c) a horizontal driven disc coaxially joined to the bottom of said egg cup, said driven disc having a diameter at least as large as the diameter of said egg cup and further having a coaxial depending stem;

(d) a vertically mounted electric motor having a drive shaft engaging the perimeter of said driven disc for rotating said driven disc and said egg cup;

(e) a circular elongated vertical support post having an aperture extending downward from the upper end for rotatably receiving the depending stem on said driven disc and supporting said driven disc with the axis of said aperture being parallel with and displaced from the longitudinal axis of said vertical support post, said vertical support post being provided with a slot in the lower end thereof for receiving a screwdriver by means of which said vertical support post is rotatably adjustable for controlling the driving friction between said motor and said driven disc; and, (f) a cellular polymeric block adapted for embedding and supporting in functional relationship therein, said electric motor and said vertical support post, said block fitting into said container.

10. An egg lathe in accordance with claim 9 in which said egg cup is detachably joined to said driven disc.

11. An egg lathe in accordance with claim 9 in which the lower end of said vertical support post is positioned in an aperture through the bottom side of said container.

12. An egg lathe for use in coloring eggs, said egg lathe comprising:

(a) a circular egg cup open at the upper end and having a base disc closing the lower end thereof, said base disc having a circular aperture on the vertical longitudinal axis of said egg cup and extending upward into said base disc;

(b) a sub-assembly having a horizontal base element, a circular pin affixed to said base element and extending vertically from the top side of said base element for engaging the aperture in the base disc of said egg cup, and an electric motor mounted on the top side of said base element with the protruding shaft thereof extending toward the vertical pin affixed to said base element and engaging the lower portion of the base disc of said egg cup for rotating said egg cup about said pin; and, (c) a cellular polymeric block adapted for embedding and supporting in functional relationship therein, said sub-assembly.

13. An egg lathe in accordance with claim 12, and further having a cover attached to the top side of said block, said cover having an aperture therethrough and surrounding said egg cup.

14. An egg lathe in accordance with claim 12, and further having a container adapted for housing said block and embedded contents.

15. An egg lathe in accordance with claim 13, and further having a container adapted for housing said block and embedded contents and said cover attached to the top side of said block.

* * * * *